US010674276B2

(12) United States Patent
Chen et al.

(10) Patent No.: US 10,674,276 B2
(45) Date of Patent: Jun. 2, 2020

(54) SPEAKER ASSEMBLY

(71) Applicant: AAC Technologies Pte. Ltd., Singapore (SG)

(72) Inventors: Zhichen Chen, Shenzhen (CN); Jianwei Chen, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,063

(22) Filed: Jul. 28, 2019

(65) Prior Publication Data

US 2020/0053475 A1 Feb. 13, 2020

(30) Foreign Application Priority Data

Aug. 9, 2018 (CN) ..... 2018 2 1282973 U

(51) Int. Cl.
*H04R 9/06* (2006.01)
*H04R 9/02* (2006.01)

(52) U.S. Cl.
CPC ..... *H04R 9/06* (2013.01); *H04R 9/02* (2013.01); *H04R 2400/11* (2013.01)

(58) Field of Classification Search
CPC .. H04R 1/2834; H04R 1/2819; H04R 1/2842; H04R 1/2873
USPC ..... 381/412
See application file for complete search history.

(56) References Cited

U.S. PATENT DOCUMENTS

2018/0132035 A1* 5/2018 Cao ..... H04R 1/02
2018/0302731 A1* 10/2018 Liu ..... H04R 31/00

FOREIGN PATENT DOCUMENTS

| | | | |
|---|---|---|---|
| CN | 201004710 | C1 | 1/2008 |
| CN | 108366334 | A1 | 8/2018 |
| CN | 208638671 | B1 | 3/2019 |
| CN | 208638675 | B1 | 3/2019 |

OTHER PUBLICATIONS

PCT search report dated Aug. 20, 2019 by SIPO in related PCT Patent Application No. PCT/CN2019/087531 (4 Pages).
PCT search report dated Jan. 2, 2020 by SIPO in related PCT Patent Application No. PCT/CN2019/111293 (4 Pages).

* cited by examiner

*Primary Examiner* — Fan S Tsang
*Assistant Examiner* — Julie X Dang
(74) *Attorney, Agent, or Firm* — W&G Law Group LLP

(57) ABSTRACT

The present disclosure provides a speaker assembly, including an upper cover and a lower cover forming an accommodation space, and a speaker fixed in the accommodation space. The upper cover includes a side wall, and the speaker divides the accommodation space into a front chamber and a rear chamber. The speaker assembly further includes an insertion plate located in the rear chamber. The speaker assembly includes a first limit structure, and one end of the insertion plate is inserted in the first limit structure for forming a sound absorbing chamber filled with sound absorbing material. The insertion plate includes a first part from the first limit structure and a second part. The speaker assembly is equipped with an insertion plate to enlarge the area of the sound absorption channel and further to improve the performance of the speaker assembly.

13 Claims, 2 Drawing Sheets

SPEAKER ASSEMBLY

FIELD OF THE PRESENT DISCLOSURE

The present disclosure relates to electro-acoustic transducer field, particularly to a speaker assembly used in a portable electronic device.

DESCRIPTION OF RELATED ART

A speaker assembly is an important acoustic component of a portable electronic device, which is used for converting electrical signals into sounds. With the volume of the speaker assembly becoming smaller and smaller, technicians usually add sound-absorbing materials in the rear chamber to absorb some sound energy, which is equivalent to enlarging the volume of the rear chamber, to make the speaker assembly perform well, reduce resonant frequency and improve sound quality.

In the related technology, there is a speaker in the accommodation space of the speaker assembly, and the rear chamber of the speaker assembly includes a sound absorbing chamber filled with sound absorbing material. The sound absorbing chamber is surrounded by a speaker cover insertion plate and an insertion plate in the accommodation space. Because the insertion plate is generally a straight insertion plate due to material, the size of the sound absorbing channel in the speaker assembly is limited, which affects the performance of speaker assembly.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to several exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
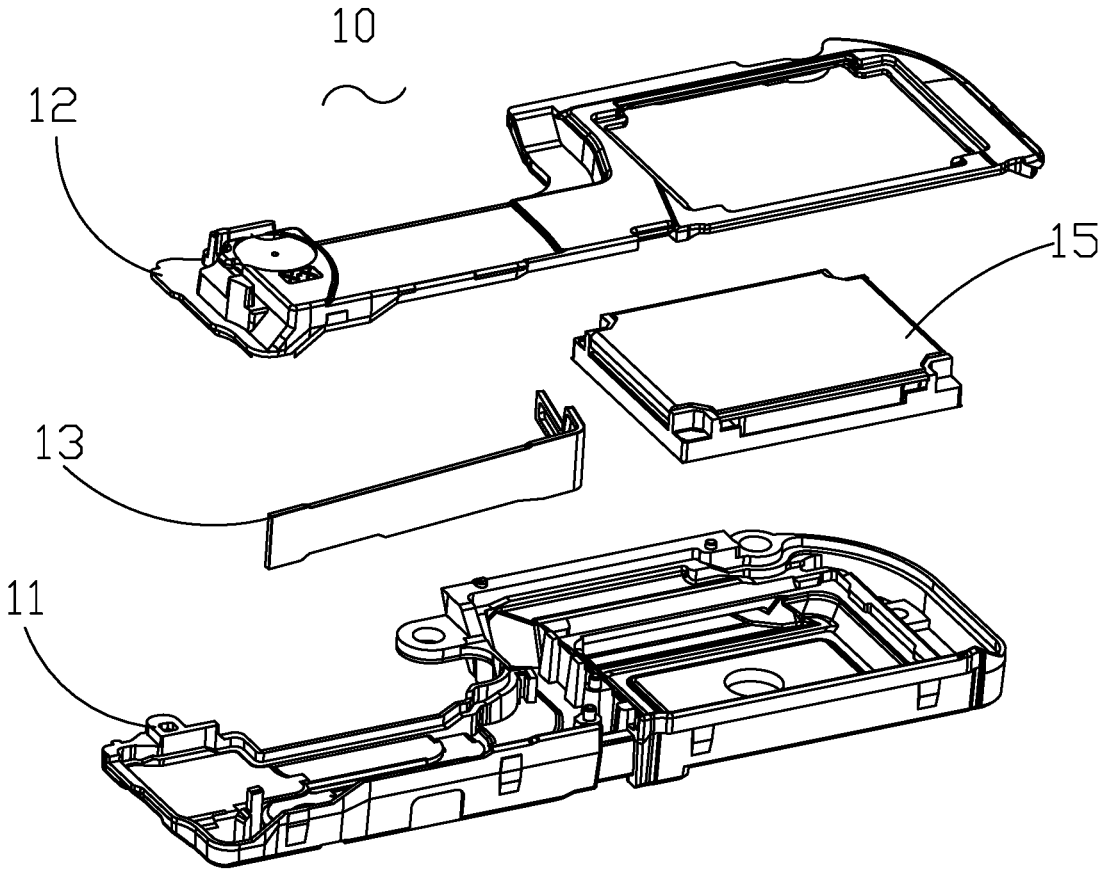
FIG. 1 is an isometric and exploded view of a speaker assembly in accordance with an exemplary embodiment of the present disclosure.
Figure 2:
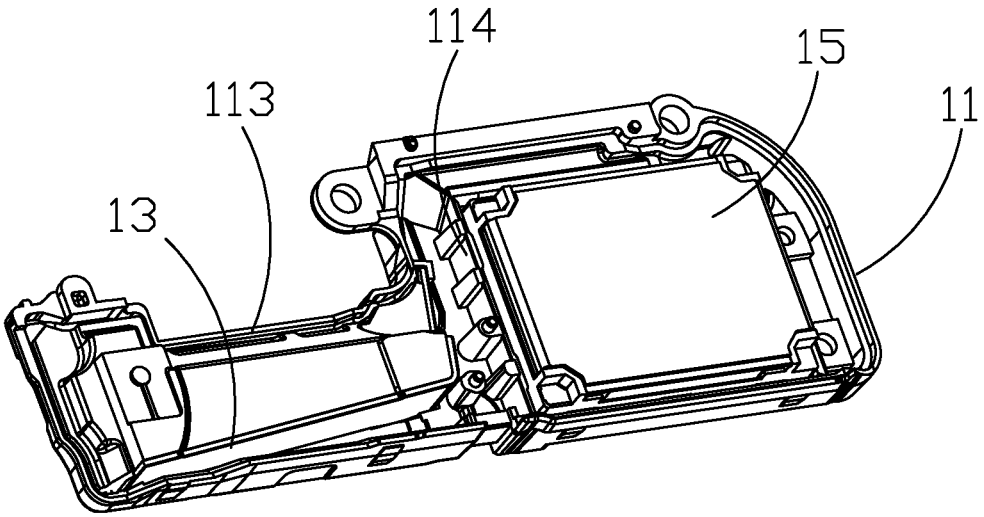
FIG. 2 is an isometric view of a part of the speaker assembly.

As shown in FIG. 1, a speaker assembly 10, in accordance with an exemplary embodiment of the present disclosure, comprises an upper cover 11 and a lower cover 12 forming cooperatively an accommodation space for accommodating a speaker 15 therein. As shown in FIG. 2, the upper cover includes a side wall 113 in the accommodation space. The speaker 15 divides the accommodation space into a front chamber and a rear chamber opposite to the front chamber.

Figure 3:
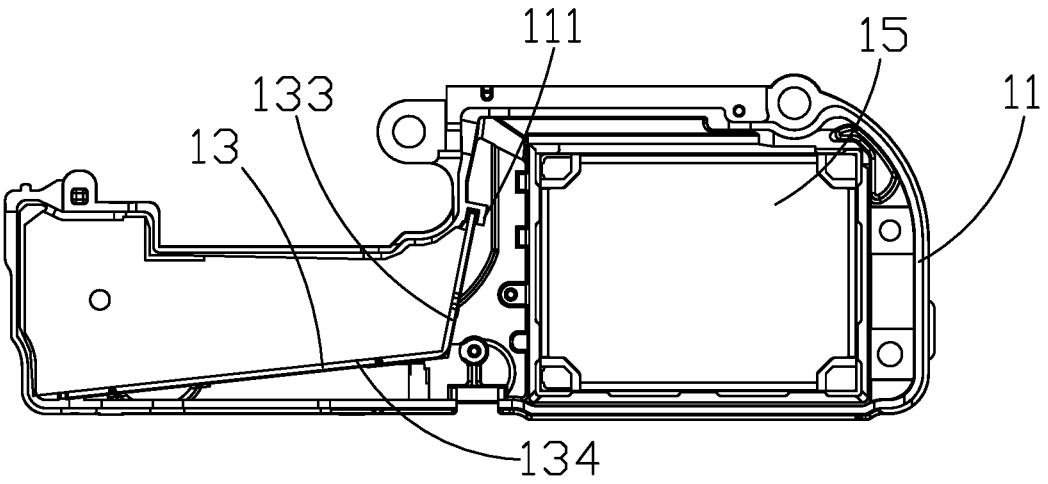
FIG. 3 is another isometric view of a part of the speaker assembly.

The speaker assembly 10 further includes an insertion plate 13 located in the rear chamber. The upper cover 11 of the speaker assembly is provided with a first limiting structure set in coordination with the insertion plate 13, and one end of the insertion plate 13 is inserted in the first limiting structure and forms, together with the side wall 113, a sound absorbing chamber filled with sound absorbing material with two openings. As shown in FIG. 3, the insertion plate 13 includes a first part 133 extending away from the speaker 15 from the first limit structure and a second part 134 bending towards the side wall 113 from an end of the first part 133.

In this way, a large sound absorption channel is formed between the first part 133 and a fixed wall 114 of the speaker in the accommodation space, and between the second part 134 and the side wall 113, which can improve the performance of the speaker assembly.

Figure 4:
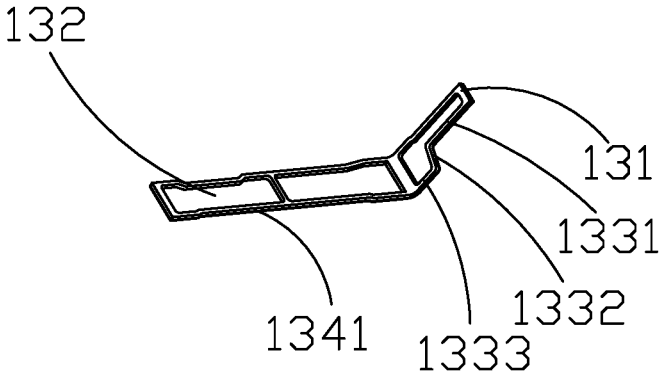
FIG. 4 is an isometric view of an insertion insertion plate of the speaker assembly.

As shown in FIG. 4, in the embodiment of the present disclosure, the insertion plate 13 includes a metal bracket 131 and a mesh 132 attached to the metal bracket 131. The metal bracket 131 may be a stainless steel bracket. The bracket made of stainless steel or other kinds of metal can make it more flexible in choosing areas to encapsulate sound-absorbing materials particles, effectively increase the area of sound-absorbing channels and improve acoustic performance.

Here, the mesh 132 can be non-woven mesh, dust-proof mesh or metal mesh. Sound energy can be absorbed by sound-absorbing particles in the sound-absorbing chamber after passing through the mesh 132.

As shown in FIG. 3, the first limit structure is a slot 111 arranged on the side wall 113, and the speaker assembly further includes a second limit structure matched with the insertion plate 13. The two ends of the insertion plate 13 are respectively inserted in the first limit structure and the second limit structure. The upper cover 11 can also be provided with a projection oriented towards an interior of the accommodation space. The second limit structure includes a gap formed by the side wall and the projection. The other end of the insertion plate is inserted in the gap.

Alternatively, the first limit structure can also be gap structure and the second limit structure can also be slot structure. The purpose is to limit the position of the insertion plate in the rear chamber.

In order to match the shape of the lower cover, as shown in FIG. 4, a side of the first part 133 includes a first connecting part 1331, a second connecting part 1332 inclined from the first connecting part 1331 in a direction away from the upper cover, and a third connecting part 1333 extending from the second connecting part 1331 in a direction away from the first connecting part 1331. A side of the second part 134 includes a fourth connecting part 1341 which extends obliquely along one end of the first part 133 towards the upper cover.

Compared with the existing technology, the speaker assembly is equipped with a bent insertion plate to enlarge the area of the sound absorption channel of the rear chamber of the speaker assembly and improve the performance of the speaker assembly.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker assembly including:

an upper cover having a side wall located in an accommodation space;

a lower cover forming the accommodation space with the upper cover;

a speaker fixed in the accommodation space for dividing the accommodation space into a front chamber and a rear chamber opposite to the front chamber;

an insertion plate located in the rear chamber;

a first limit structure corresponding to the insertion plate; wherein one end of the insertion plate is inserted in the first limit structure for forming a sound absorbing chamber with two openings together with the side wall for being filled with sound absorbing material; and wherein the insertion plate includes a first part extending away from the speaker from the first limit structure and a second part bending towards the side wall from an end of the first part.

2. The speaker assembly as described in claim 1, wherein the insertion plate comprises a metal bracket and a mesh attached to the metal bracket.

3. The speaker assembly as described in claim 2, wherein the first limit structure is a slot arranged in the side wall.

4. The speaker assembly as described in claim 3, wherein the upper cover includes a projection towards an interior of the accommodation space, the speaker assembly further includes a second limit structure engaging with the insertion plate, and the second limit structure includes a gap formed by the side wall and the projection, and the other end of the insertion plate is inserted in the gap.

5. The speaker assembly as described in claim 4, wherein a side of the first part includes a first connecting part, a second connecting part extending obliquely from the first connection portion in a direction away from the upper cover, and a third connecting part extending from the second connecting part in a direction far away from the first connecting part.

6. The speaker assembly as described in claim 4, wherein a side of the second part includes a fourth straight line extending obliquely along one end of the first part in a direction toward to the upper cover.

7. The speaker assembly as described in claim 1, wherein the metal bracket comprises a stainless steel bracket.

8. The speaker assembly as described in claim 2, wherein the metal bracket comprises a stainless steel bracket.

9. The speaker assembly as described in claim 3, wherein the metal bracket comprises a stainless steel bracket.

10. The speaker assembly as described in claim 4, wherein the metal bracket comprises a stainless steel bracket.

11. The speaker assembly as described in claim 5, wherein the metal bracket comprises a stainless steel bracket.

12. The speaker assembly as described in claim 6, wherein the metal bracket comprises a stainless steel bracket.

13. The speaker assembly as described in claim 7, wherein the mesh is at least one of non-woven mesh, dust-proof mesh and metal mesh.

* * * * *